United States Patent [19]

Ruthel et al.

[11] 4,178,225

[45] Dec. 11, 1979

[54] CATHODE BUSBAR STRUCTURE

[75] Inventors: Walter W. Ruthel, Grand Island; Leo G. Evans, Tonawanda, both of N.Y.

[73] Assignee: Hooker Chemicals & Plastics Corp., Niagara Falls, N.Y.

[21] Appl. No.: 852,401

[22] Filed: Nov. 14, 1977

Related U.S. Application Data

[63] Continuation of Ser. No. 590,799, Jun. 26, 1975, abandoned, which is a continuation-in-part of Ser. No. 430,428, Jan. 3, 1974, abandoned.

[51] Int. Cl.[2] ..... C25B 9/04

[52] U.S. Cl. ..... 204/279; 204/258

[58] Field of Search ..... 204/242, 252, 258, 266, 204/270, 278, 279

[56] References Cited

U.S. PATENT DOCUMENTS

| | | | |
|---|---|---|---|
| 2,447,547 | 8/1968 | Stuart | 204/266 |
| 3,432,422 | 3/1969 | Currey | 204/258 |
| 3,464,912 | 9/1969 | Emery et al. | 204/266 |
| 3,498,903 | 3/1970 | Kamarjan | 204/266 |
| 3,783,122 | 1/1974 | Sato et al. | 204/258 |

*Primary Examiner*—T. Tung

*Attorney, Agent, or Firm*—Peter F. Casella; Thomas T. Gordon; William G. Gosz

[57] ABSTRACT

A cathode busbar structure is provided for an electrolytic cell which can enable the electrolytic cell to be designed to operate as a chlor-alkali diaphragm cell at high current capacities of about 150,000 amperes and upward to about 200,00 amperes while maintaining high operating efficiencies while in normal or jumpered operation. These high current capacities provide for high production capacities which result in high production rates for given cell room floor areas and reduce capital investment and operating costs.

4 Claims, 2 Drawing Figures

CATHODE BUSBAR STRUCTURE

This application is a continuation of application Ser. No. 590,779, filed June 26, 1975 which is in turn a continuation-in-part of application Ser. No. 430,428 filed Jan. 3, 1974, both now abandoned.

This application is related to U.S. Pat. No. 3,859,196 which issued Jan. 7, 1975 from U.S. Patent Application Ser. No. 430,427 filed Jan. 3, 1974 which discloses an electrolytic cell provided with the cathode busbar structure claimed in this application.

BACKGROUND OF THE INVENTION

This invention relates to a cathode busbar structure for electrolytic cells suited for the electrolysis of aqueous solutions. More particularly, this invention relates to a cathode busbar structure for electrolytic cells suited for the electrolysis of aqueous alkali metal chloride solutions.

Electrolytic cells have been used extensively for many years for the production of chlorine, chlorates, chlorites, hydrochloric acid, caustic, hydrogen and other related chemicals. Over the years, such cells have been developed to a degree whereby high operating efficiencies have been obtained, based on the electricity expended. Operating efficiencies include current, decomposition, energy, power and voltage efficiencies. The most recent developments in electrolytic cells have been in making improvements for increasing the production capacities of the individual cells while maintaining high operating efficiencies. This has been done to a large extent by modifying of redesigning the individual cells and increasing the current capacities at which the individual cells operate. The increased production capacities of the individual cells operating at higher current capacities provide higher production rates for given cell room floor areas are reduce capital investment and operating costs.

In general, the most recent developments in electrolytic cells have been towards larger cells which have high production capacities and which are designed to operate at high current capacities while maintaining high operating efficiencies. Within certain operating parameters, the higher the current capacity at which a cell is designed to operate, the higher is the production capacity of the cell. As the designed current capacity of a cell is increased, however, it is important that high operating efficiencies be maintained. Mere enlargement of the component parts of a cell designed to operate at low current capacity will now provide a cell which can be operated at high current capacity and still maintain high operating efficiencies. Numerous design improvements must be incorporated into a high current capacity cell so that high operating efficiencies can be maintained and high production capacity can be provided.

In mere scaling up of existing electrolytic cell hardware, problems are encountered in current distribution to the cell. The solution of additional or larger busbars, although not economic, is also not feasible because of the amount of welding of large sections of metals and cracking of welds because of slight vibrations together with the weight of the components which are welded together.

Because the present invention may be used in many different electrolytic cells of which chlor-alkali cells are of primary importance, the present invention will be described more particularly with respect to chlor-alkali cells and most particularly with respect to chlor-alkali diaphragm cells. However, such description are not to be understood as limiting the usefulness of the present invention with respect to other electrolytic cells.

In the early prior art, chloro-alkali diaphragm cells were designed to operate at relatively low current capacities of about 10,000 amperes or less and had correspondingly low production capacities. Typical of such cells is the Hooker Type S Cell, developed by the Hookers Chemical Corporation, Niagara Falls, New York, U.S.A., which was a major breakthrough in the electrochemical art at its time of development and initial use. The Hooker Type S Cell was subsequently improved by Hooker in a series of Type S cells such as the Type S-3, S-3A, S-3B, S-3C, S-3D and S-4, whereby the improved cells were designed to operate at progressively higher current capacities of about 15,000 20,000, 25,000, 30,000, 40,000 and upward to about 55,000 amperes with correspondingly higher production capacities. The design and performance of these Hooker Type S cells are discussed in Shreve, *Chemical Process Industries,* Third Edition, Page 233 (1967), McGraw-Hill; Mantell, *Industrial Electrochemistry,* Third Edition, Page 434 (1950), McGraw-Hill; and Scone, *Chlorine, Its Manufacture, Properties and Uses,* A.C.S. Monograph, Pages 94–97 (1962). Reinhold. U.S. Pat. No. 2,987,463 by Baker et al., issued June 6, 1961, to Diamond Alkali discloses a chloralkali diaphrarm cell designed to operate at a current capacity of about 30,000 amperes which is somewhat different than the Hooker Type S series cells. U.S. Pat. Nos. 3,464,912 by Emery et al., issued Sept. 2, 1969, to Hooker and 3,493,487 by Currey et al. issued Nov. 2, 1971 to Hooker disclose chlor-alkali diaphragm cells designed to operate at a current capacity of about 60,000 amperes.

The above description of the prior art shows the development of chlor-alkali diaphragm cell design to provide cells which operate at higher current capacities with correspondingly high production capacities. Chlor-alkali diaphragm cells have now been developed which operate at high current capacities of about 150,000 amperes and upward to about 200,000 amperes with correspondingly higher production capacities while maintaining high operating efficiencies.

Electrolytic cells operating at such high current require an efficient distribution system in order to avoid heating or the buildup of heat in localized areas which may cause malfunction of the cell.

In the normal operation of a plant utilizing electrolytic cells, the removal of a single cell from a circuit of cells is required to service the cell removed from the circuit. When this is done the cell so removed is skipped or jumpered and the current is directed around that cell by electrically connecting the two adjacent cells. Although that is usually a temporary arrangement, until the problem with the jumpered cell is remedied, the high current being utilized requires an efficient current distribution system to be used in the cells being connected in the jumpering operation; otherwise the problem of localized heat or heat buildup occurs and may result in a rapid malfunction of the cells affected.

The cathode busbar structure of the present invention provides an efficient current distribution both during normal cell operation or during jumpered operation.

SUMMARY OF THE INVENTION

In accordance with the present invention, there is provided a cathode busbar structure for an electrolytic cell, which cathode busbar structure will provide an efficient current distribution in either normal or in jumpering operation.

The present cathode busbar structure comprises at least one lead-in busbar and a plurality of busbar strips which have different relative dimensions. The lead-in busbar or busbars and the plurality of busbar strips are fabricated from a highly conductive metal and are positioned in such a configuration wherein the lead-in busbar or busbars and the plurality of busbar strips are adapted to carry an electric current and to maintain a substantially uniform current density through the cathode busbar structure to electrical contact points adjacent to the cathode fingers without any significant voltage drop across the cathode busbar structure in either normal or jumpered operation and with the most economical power consumption in the cathode busbar structure. The cathode busbar structure is attached to at least one sidewall of a cathode walled enclosure. The cathode walled enclosure contains a plurality of cathode fingers which extend substantially across the interior of the cathode walled enclosure and the cathode fingers are attached in electrical contact to at least one interior sidewall of the cathode walled enclosure. The cathode busbar structure is attached in electrical contact to the exterior sidewall of the cathode walled enclosure, adjacent to the attached cathode fingers.

The present cathode busbar structure makes the most economic use of invested capital, namely the amount of highly conductive metal used in the cathode busbar structure. The configuration and different relative dimensions of the lead-in busbar or busbars and the plurality of busbar strips significantly reduce the amount of highly conductive metal required in the cathode busbar structure as compared to the prior art. The lead-in busbar or busbars and the plurality of busbar strips by means of their configuration and different relative dimensions are also adapted to carry an electric current and to maintain a substantially uniform current density through the cathode busbar structure and in distribution of current to the cell.

The present cathode busbar structure is provided with means for attaching a cathode jumper connection when an adjacent electrolytic cell is jumpered and is removed from the electrical circuit. The present arrangement of components is also adapted to have high electric current capacity while maintaining a substantially uniform current density through the cathode busbar structure (and distribution to the cell) while the cell or cells are in jumpered operation. Although a jumpered operation is temporary, the present arrangement allows the cells or cells connected to remain in such position without the danger of localized heating or heat buildup which would limit the time the cells could be maintained in a jumpered position.

The cathode busbar structure can also be provided with cooling means to prevent temperatures in the cathode busbar structure from rising to damaging levels and to further reduce the amount of highly conductive metal required in the cathode busbar structure.

An electrolytic cell provided with the cathode busbar structure of the present invention may be used in many different electrolytic processes. The electrolysis of aqueous alkali metal chloride solutions is of primary importance and the present invention will be described more particularly with respect to this type of process. However, such description is not intended to be understood as limiting the usefulness of the present cathode busbar structure or any of the claims covering the present cathode busbar structure.

DESCRIPTION OF THE DRAWINGS

The present invention will be more fully described by reference to the drawings in which.

Two different types of metals are used to fabricate most of the various components or parts which comprise the present cathode busbar structure. One of these types of metals is a highly conductive metal. The other type of metal is a conductive metal which has good strength and structural properties.

The term highly conductive metal is herein defined as a metal which has a low resistance to the flow of electric current and which is an excellent conductor of electric current. Suitable highly conductive metals include copper, aluminum, silver and the like and alloys thereof. The preferred highly conductive metal is copper or any of its highly conductive alloys and any mention of copper in this application is to be interpreted to mean that any other suitable highly conductive metal can be used in the place of copper or any of its highly conductive alloys where it is feasible or practical.

The term conductive metal is herein defined as a metal which has a moderate resistance to the flow of electric current but which is still a reasonably good conductor of electric current. The conductive metal, in addition, has good strength and structural properties. Suitable conductive metals include iron, steel, nickel and the like and alloys therof such as stainless steel and other chromium steels, nickel steels and the like. The preferred condutive metal is a relatively inexpensive low-carbon steel, hereinafter referred to simply as steel, and any mention of steel in this application is to be interpreted to mean that any other suitable conductive metal can be used in the place of steel where it is feasible or practical.

The highly conductive metal and the conductive metal should have adequate resistance to or have adequate protection from corrosion during operation of the electrolytic cell.

Figure 1:
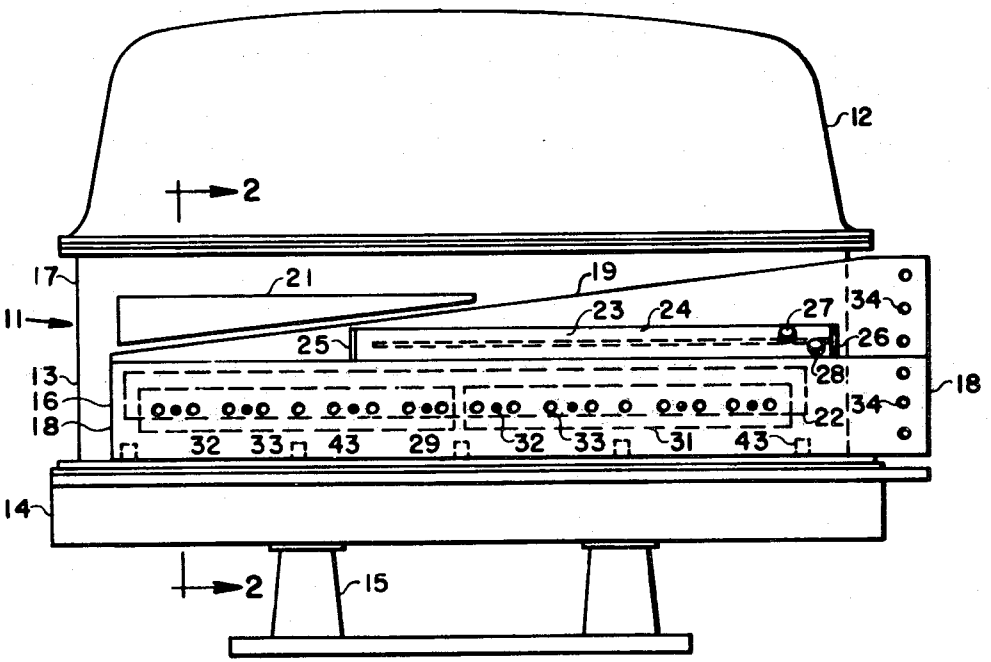
FIG. 1 is an elevation view of an electrolytic cell and shows a typical cathode busbar structure of the present invention.

Referring now to FIG. 1, electrolytic cell 11 comprises corrosion resistance plastic top 12, cathode walled enclosure 13 and cell base 14. Top 12 is positioned on cathode walled enclosure 13 and is secured to cathode walled enclosure 13 by fastening means (not shown). A steel is maintained between top 12 and cathode walled enclosure 13 by means of a sealing gasket. Cathode walled enclosure 13 is positioned on cell base 14 and is secured to cell base 14 by fastening means (not shown). A seal is maintained between cathode walled enclosure 13 and cell base 14 by means of an elastomeric sealing pad. Electrolytic cell 11 is positioned on legs 15 which are used as support means for the cell.

The cathode busbar structure comprises copper lead-in busbar 18 and a plurality of copper busbar strips 19, 21 and 22 which have different relative dimensions and are positioned in such a configuration wherein lead-in busbar 18 and busbar strips 19, 21 and 22 are adapted to carry an electric current and to maintain a substantially uniform current density through cathode busbar structure to electrical contact points on sidewall 17 of cathode walled enclosure 13 whether the cell is connected in normal operation with the other cells in a circuit or whether the cell is connected in a jumpered position with another cell.

The cathode busbar structure may also be provided with cooling means 23 which comprises steel plates 24, 25 and 26 and entrance and exit ports 27 and 28 fabricated in any suitable manner, as by welding, to form the said cooling means. Cooling means 23 may be attached in any suitable manner, as by welding, suitably to lead-in busbar 18 and busbar strip 19. Coolant, preferably water, is circulated through cooling means 23 by passage through entrance and exit ports 27 and 28. Cooling means 23 is provided primarily for use when an electrolytic cell adjacent to electrolytic cell 11 is jumpered and is removed from the electrical circuit. The use of cooling means 23 permits considerably less copper to be used in cathode busbar structure which results in a substantial reduction in capital investment costs for cathode copper. While cooling means 23 is provided primarily for use when an electrolytic cell adjacent to electrolytic cell 11 is jumpered, cooling means 23 can be used during routine cell operation either to cool cathode busbar structure during any periodic electric current overloads or to continuously cool cathode busbar structure, thereby permitting further reductions in the use of copper in the cathode structure with an accompanying reduction in capital investment costs for cathode copper.

Lead-in busbar 18 is provided with steel contact plates 29 and 31 which serve as contact means. Steel contact plates 29 and 31 are attached to lead-in busbar 18 in any suitable manner, as by means of screws 32. Lead-in busbar 18 and steel contact plates 29 and 31 are provided with holes 33 which serve as means for attaching intercell connectors carrying electricity from an adjacent cell or leads carrying electricity from another source to lead-in busbar 18. Lead-in busbar 18 and busbar strip 19 are suited to use as a cathode jumper busbar said busbar 18 and busbar strip 19 being provided with holes 34, which serve as means for attaching cathode jumper connectors when an adjacent electrolytic cell is jumpered and is removed from the electrical circuit. It is during this jumpering operation that cooling means 23 can provide its greatest utility by preventing the temperatures in the cathode busbar structure from rising to levels whereby damage to cathode busbar structure or other components of electrolytic cell 11 may occur.

Figure 2:
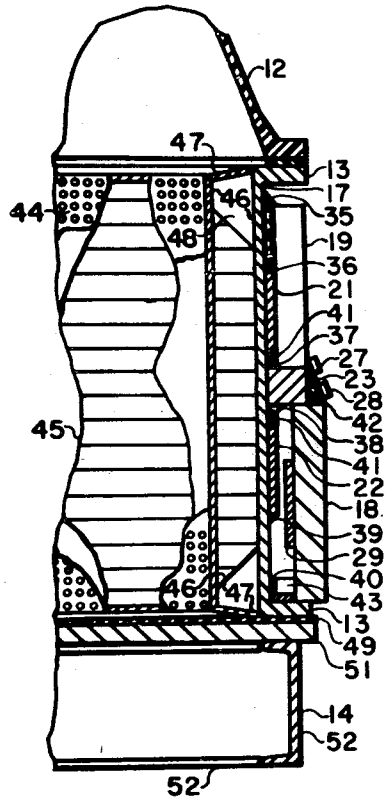
FIG. 2 is an enlarged partial sectional side elevation view of the cell of FIG. 1 along plane 2—2 and shows another view of the cathode busbar structure.

Referring now to FIG. 2, the cathode busbar structure is shown in another view cut along section lines 2—2 of FIG. 1.

Cathode busbar structure comprises copper lead-in busbar 18 and a plurality of copper busbar strips 19, 21 and 22. Busbar strips 19, 21 and 22 are attached to steel sidewall 17 of steel cathode walled enclosure 13 in any suitable manner, as by means of copper to steel welds 35, 36, 37, 38, and 39, and to one another in any suitable manner, as by means of copper to copper welds 41. The weld metal is preferably of the same metal as the busbar strips, that is, copper. This means of attaching the busbar strips to sidewall 17 greatly decreases the required weld area and forms a lower electrical contact resistance to sidewall 17 or the cathode steel. Lead-in busbar 18 is attached to busbar strip 19 in any suitable manner, as by means of copper to copper weld 42, and lead-in busbar 18 is spacedly attached to sidewall 17 in any suitable manner, as by means of steel blocks 43. Lead-in busbar 18 is attached to steel blocks 43 in any suitable manner, as by a combination of screws (not shown) and steel blocks 43 are attached to sidewall 17 of cathode walled enclosure 13 in any suitable manner, as by means of steel to steel welds 40. Steel contact plates 29 and 31 are attached to lead-in busbar 18 in any suitable manner, as by means of screws 32.

The above means of attachment provides a cathode busbar structure wherein lead-in busbar 18 and the plurality of busbar strips 19, 21 and 22 are attached and electrically interconnected and the cathode busbar structure is attached in electrical contact to sidewall 17 of cathode walled enclosure 13.

Cathode fingers 44 are attached in electrical contact to sidewall 17 in any suitable manner, as by welding cathode finger reinforcing means 45 to sidewall 17. A typical cathode finger 44 is partially shown. Cathode finger 44 comprises steel cathode finger reinforcing means 45 and perforated steel plates 46 which are attached in any suitable manner, as by welding. Perforated steel plates 47 are attached in any suitable manner, as by welding, to perforated steel plates 46 and sidewall 17, thereby forming a peripheral chamber 48.

The height of the plurality of the busbar strips at their points of attachment to sidewall 17 is usually substantially equal to the height of cathode finger reinforcing means 45 at their points of attachment to sidewall 17. This height can be further defined as being of more than about one-half of the height cathode walled enclosure 13. The thickness of busbar strips 21 and 22 are preferably less than those of lead-in busbar 18 and busbar strip 19.

Cathode walled enclosure 13 is positioned on cell base 14 and is secured to cell base 14 by fastening means (not shown). Cell base 14 comprises elastomeric sealing pad 49 and conductive anode base 51 and, if needed, structural support means 52. A seal is maintained between cathode walled enclosure 13 and cell base 14 by means of elastomeric sealing pad 49.

In a typical circuit of electrolytic cells, electric current is carried through intercell connectors (not shown) to lead-in busbar 18 of the cathode busbar structure. Electrical connection in normal cell operation is through lead-in busbar 18 utilizing holes 33 to physically and electrically connect electrolytic cell 11 in the circuit by means of intercell connectors (not shown). Electric current is then carried through lead-in busbar 18 and distributed to cell 11 while maintaining a substantially uniform current density through the cathode busbar structure and without any significant voltage drop across the cathode busbar structure. Electric current is carried and a substantially uniform current density is maintained through cathode busbar structure by means of the configuration and the different relative dimensions of lead-in busbar 18 and busbar strips 19, 21 and 22. Electric current is thus carried through cathode busbar structure 16 to electrical contact points on sidewall 17 of cathode walled enclosure 13 where it is distributed to cathode fingers 44 and, under these conditions, the electric current is readily carried to all sections of perforated steel plates 46 with a minimum electrical resistance through cathode finger reinforcing means 45.

In a typical jumpering operation wherein an adjacent cell to cell 11 is removed from service, electric current is carried through jumpering connectors (not shown) to lead-in busbar 18 of the cathode busbar structure. Electrical connection in a jumpering operation is also through lead-in busbar 18 utilizing holes 34 to physically and electrically connect cell 11 in the circuit while by-passing an adjacent cell. Electric current is then carried through busbar strip 19 and lead-in busbar 18 and is distributed to cell 11 while maintaining a substantially uniform current density through the cathode busbar structure and cell operated in substantially the same manner and current distribution as in normal operation.

Thus it can be seen that the present cathode busbar structure provides high current capacity and a means of maintaining a substantially uniform current density when handling high electrical current loads both in normal operation wherein the electrical connection is via the length of lead-in busbar 18, or in jumpering operation wherein the electrical connection is via the sides of busbar strip 19 and lead-in busbar 18, a substantially smaller connecting area than the length of lead-in busbar 18.

The configuration and dimensions of the lead-in busbar or busbars and the plurality of busbar strips can vary depending on the designed current capacity of the electrolytic cell and also can vary depending on a number of factors such as the current density, the conductivity of the metal used, the amount of weld area, the fabrication costs and the like.

The present cathode busbar structure provides an efficient current distribution system in either normal or jumpering operation. Normally current flows via lead-in busbar 18 which is positioned generally across one side of cell 11, which is cathode walled enclosure 13, via busbar strips 19, 21 and 22 which are in both physical (through welds) and electrical contact with both the cathode walled enclosure 13 and lead-in busbar 18. One end of busbar 18 extends outward of cathode walled enclosure 13 and is adapted for electrical jumpering connection. Busbar strip 19 is also positioned generally across the width of cathode walled enclosure 13, and also has one end extending outward of cathode walled enclosure 13 and is adapted for electrical jumpering connection. Busbar strip 19 is tapered with the larger end being closest the end adapted for electrical jumpering connection.

Suitably lead-in busbar 18 and busbar strips 19, 21 and 22 are fabricated of bar stock. Lead-in busbar 18 and busbar strip 19 are aptly the same approximate thickness and busbar strips 21 and 22 are of thinner stock. The tapering of busbar strips 19 and 21 give different relative dimension to the components.

Because of the relatively small connection area which is utilized in jumpering, namely the ends of lead-in busbar 18 and busbar strip 19 (as compared to normal connection along the length of lead-in busbar 18) the present cathode busbar structure provides more highly conductive material nearer the jumpering connection than elsewhere in the structure, yet provides a relatively uniform current distribution system under normal cell operations. This arrangement also provides greater immediate electrical contact area with the cathode walled enclosure during jumpering operation, the portion of the cathode walled enclosure nearest the jumpering connection.

The cathode busbar structure provides improved electrical conductivity to the immediate area of the cathode fingers, whether being utilized in normal cell operation or in a jumpered operation, thereby providing a minimum or no significant voltage drop across the cathode busbar structure with a substantial reduction in copper or other suitable highly conductive metal expenditures as compared to the prior art.

The novel busbar structure can enable an electrolytic cell to be designed to operate as a chlor-alkali diaphragm cell at high current capacities of about 150,000 amperes and upward to about 200,000 amperes while maintaining high operating efficiencies in either normal or jumpered operations. These high current capacities provide for high production capacities which result in high production rates for given cell room floor areas and reduce capital investment and operating costs. In addition to being capable of operation at high amperages, an electrolytic cell can also efficiently operate at lower amperages, such as about 55,000 amperes, using the novel cathode busbar structure.

PREFERRED EMBODIMENTS

The following example illustrates the practice of the present invention and a mode of utilizing the present invention.

EXAMPLE

The following data are typical of the performance of an electrolytic cell provided with the present cathode busbar structure operating at a current capacity of 150,000 amperes. The performance is compared with the performance of a smaller electrolytic cell of the prior art. Both cells were equipped with metal anode blades. The smaller cell was operated at a current capacity of 84,000 amperes. Both electrolytic cells are chlor-alkali diaphragm cells.

| | 84,000 Ampere Cell of the Prior Art | 150,000 Ampere Cell Provided with the Cathode Busbar Structure of the Present Invention |
|---|---|---|
| Current Efficiency | 96.4 | 96.4 |
| Average Cell Voltage (including busbars) | 3.84 | 3.83 |
| Power-KWHDC/Ton $Cl_2$ | 2735 | 2725 |
| Cell Liquor Temperature-°C. | 100.5 | 100.7 |
| Anolyte Temperature-°C. | 94.5 | 94.7 |
| Percent NaOH in Cell Liquor | 11.5* | 11.5* |
| Chlorine Production-Tons/Day | 2.83 | 5.06 |
| NaOH Production-Tons/Day | 3.20 | 5.71 |
| Brine Feed - Grams/Liter | 325 | 325 |
| Current Density-Amperes/Sq. In. | 1.5 | 1.5 |

*The cells can be operated at lower caustic content in the cell liquor. This will result in greater current efficiencies.

The above data show that the electrolytic cell provided with the cathode busbar structure of the present invention operates at essentially the same current efficiency, voltage and operating conditions as the smaller electrolytic cell of the prior art at the same anode current density. The electrolytic cell provided with the cathode busbar structure of the present invention has a higher production rate for a given cell room floor area, uses less operating labor and also has a lower capital investment per ton of chlorine produced.

This example shows that an electrolytic cell can be designed to operate at a high current capacity to provide a high production capacity and a high production rate while maintaining high operating efficiencies.

An electrolytic cell provided with the cathode busbar structure of the present invention can have many other uses. For example, alkali metal chlorates can be produced using the electrolytic cell by further reacting the formed caustic and chlorine outside of the cell. In this instance, solutions containing both alkali metal chlorate and alkali metal chloride can be recirculated to the electrolytic cell for further electrolysis. The electrolytic cell can be utilized for the electrolysis of hydrochloric acid by electrolyzing hydrochloric acid alone or in combination with an alkali metal chloride. Thus, the electrolytic cell is highly useful in these and many other aqueous processes.

While there have been described various embodiments of the present invention, the apparatus described is not intended to be understood as limiting the scope of the present invention. It is realized that changes therein are possible. It is further intended that each component recited in any of the following claims is to be understood as referring to all equivalent components for accomplishing the same results in substantially the same or an equivalent manner. The following claims are intended to cover the present invention broadly in whatever form the principles thereof may be utilized.

What is claimed is:

1. A cathode busbar structure for an electrolytic cell having a high current capacity comprising (a) a conductive cathode walled enclosure;

(b) at least one lead-in busbar, a side portion of said lead-in busbar extending outward of said cathode walled enclosure and adapted for electrical jumpering connection, said lead-in busbar being parallel to but not in physical contact with said cathode walled enclosure and adapted for electrical intercell connection along the lengthwise portion thereof;

(c) a plurality of busbar elements, physically contacting said cathode walled enclosure, electrically connected to said lead-in busbar, one element of the plurality of busbar elements of a tapered configuration having the larger end portion extending outward of said cathode walled enclosure adapted for electrical jumpering connection, said tapered busbar element being thicker than the remaining busbar elements, and said plurality of busbar elements combining to form an essentially rectangular electrical contact area on the cathode walled enclosure.

2. The cathode busbar structure of claim 1 wherein the conductive cathode walled enclosure is fabricated from steel.

3. The cathode busbar structure of claim 1 wherein the structure is provided with a cooling means to prevent temperature in said structure from rising to levels whereby damage to the cathode busbar structure may occur.

4. The cathode busbar structure of claim 1 wherein the lead-in busbar and the plurality of busbar elements are fabricated from copper.

* * * * *